US008408647B2

(12) United States Patent
Wu

(10) Patent No.: US 8,408,647 B2
(45) Date of Patent: Apr. 2, 2013

(54) MOVABLE CHAIR BACKREST

(76) Inventor: Yao-Chuan Wu, Chiayi Hsien (TW)

( * ) Notice: Subject to any disclaimer, the term of this patent is extended or adjusted under 35 U.S.C. 154(b) by 392 days.

(21) Appl. No.: 12/784,587

(22) Filed: May 21, 2010

(65) Prior Publication Data

US 2011/0285190 A1 Nov. 24, 2011

(51) Int. Cl.
*A47C 3/00* (2006.01)

(52) U.S. Cl. ..... 297/285; 297/299; 297/301.1

(58) Field of Classification Search ..... 297/285, 297/301.1, 354.1, 284.4, 299, 354.11
See application file for complete search history.

(56) References Cited

U.S. PATENT DOCUMENTS

| | | | | |
|---|---|---|---|---|
| 4,585,272 | A * | 4/1986 | Ballarini | 297/284.3 |
| 5,102,196 | A * | 4/1992 | Kaneda et al. | 297/452.15 |
| 5,649,739 | A * | 7/1997 | Zapf | 297/301.1 |
| 6,257,665 | B1 * | 7/2001 | Nagamitsu et al. | 297/285 |
| 6,471,293 | B2 * | 10/2002 | Ware et al. | 297/239 |
| 6,843,530 | B1 * | 1/2005 | Wu | 297/284.4 |
| 6,896,327 | B1 * | 5/2005 | Barile, Sr. | 297/297 |
| 6,945,601 | B1 * | 9/2005 | Wu | 297/284.4 |
| 7,475,943 | B1 * | 1/2009 | Huang | 297/284.4 |
| 7,731,286 | B2 * | 6/2010 | Wu | 297/284.4 |
| 8,272,691 | B2 * | 9/2012 | Hsuan-Chin | 297/285 |
| 2003/0025370 | A1 * | 2/2003 | Hensel et al. | 297/285 |
| 2003/0111885 | A1 * | 6/2003 | McMillen | 297/284.4 |
| 2004/0140701 | A1 * | 7/2004 | Schmitz et al. | 297/284.4 |
| 2004/0183350 | A1 * | 9/2004 | Schmitz et al. | 297/301.1 |
| 2005/0179290 | A1 * | 8/2005 | Hancock et al. | 297/284.4 |
| 2007/0057556 | A1 * | 3/2007 | Kang | 297/354.1 |
| 2008/0231095 | A1 * | 9/2008 | Brauning | 297/219.1 |
| 2009/0127905 | A1 * | 5/2009 | Schmitz et al. | 297/284.4 |
| 2009/0230751 | A1 * | 9/2009 | Wu | 297/452.18 |
| 2011/0215623 | A1 * | 9/2011 | Tsai | 297/301.1 |
| 2011/0304183 | A1 * | 12/2011 | van Hekken | 297/313 |
| 2012/0193959 | A1 * | 8/2012 | Chen | 297/301.1 |

* cited by examiner

*Primary Examiner* — David Dunn
*Assistant Examiner* — David E Allred
(74) *Attorney, Agent, or Firm* — Alan Kamrath; Kamrath IP Lawfirm, P.A.

(57) ABSTRACT

A movable chair backrest is substantially composed of an upper board pivotally attached to a front of a backrest frame. A lower end of the upper board is connected to a lower board by a resilient sheet. A bouncing board connects between the lower board and the backrest frame. Therefore, the lower board operationally swings forward, backward, rightward, leftward relative to the upper board to correspond to different sitting and leaning postures of a user.

4 Claims, 6 Drawing Sheets

MOVABLE CHAIR BACKREST

BACKGROUND OF THE INVENTION

1. Field of the Invention

The present invention relates to a movable chair backrest composed of an upper board and a lower board connected by a resilient sheet. The upper board is pivotally attached to a front of a backrest frame, and the lower board is attached to the backrest frame with a bouncing board. Thus, the chair backrest operationally deforms according to the user's back curve to provide a buffer efficiency.

2. Description of Related Art

In the structure of a chair, the backrest is important in design to support the body back. Moreover, to improve the comfort level, design for human body engineering is indispensable.

In the conventional art of chair design, an adjuster is secured inside the backrest to adjust. Although the backrest can be changed, by operating the adjuster, to make the chair fit to different users' backs having different sizes, a user has to sit in a certain posture to obtain the benefit of body engineering. When the user changes posture, the backrest after adjusting cannot provide comfortable support, because the backrest is fixed and has no corresponding adjustment immediately. Therefore, the adjuster is important to users and is operated frequently to keep the chair comfortable. Not only is the operation of the adjuster frequent and troublesome, but, also, the adjuster will malfunction often. If not controlling the adjuster, the user easily gets tired after sitting on the chair for a long duration. Such drawbacks are attributable so that the user has to adjust the conventional chair often.

SUMMARY OF THE INVENTION

A main objective of the present invention is to provide a movable chair backrest that automatically changes shapes to correspond to the user's postures.

To achieve the foregoing objective, the movable chair backrest comprises an upper board and a lower board connected to the upper board. The upper board is pivotally attached to a backrest frame. The lower board is secured to the backrest frame by a bouncing board. The upper board and the lower board are connected by a resilient sheet. The bouncing board pushes the lower board apart from the backrest frame to make a buffering distance between the backrest frame and the backrest.

Further benefits and advantages of the present invention will become apparent after a careful reading of the detailed description with appropriate reference to the accompanying drawings.

DETAILED DESCRIPTION OF THE PREFERRED EMBODIMENTS

A movable chair backrest in accordance with the present invention is substantially composed of an upper board pivotally attached to a front of a backrest frame. A lower end of the upper board is connected to a lower board by a resilient sheet. A bouncing board connects between the lower board and the backrest frame. Therefore, the lower board operationally swings forward, backward, rightward, and leftward relative to the upper board to correspond to different sitting and leaning postures of a user.

Figure 1:
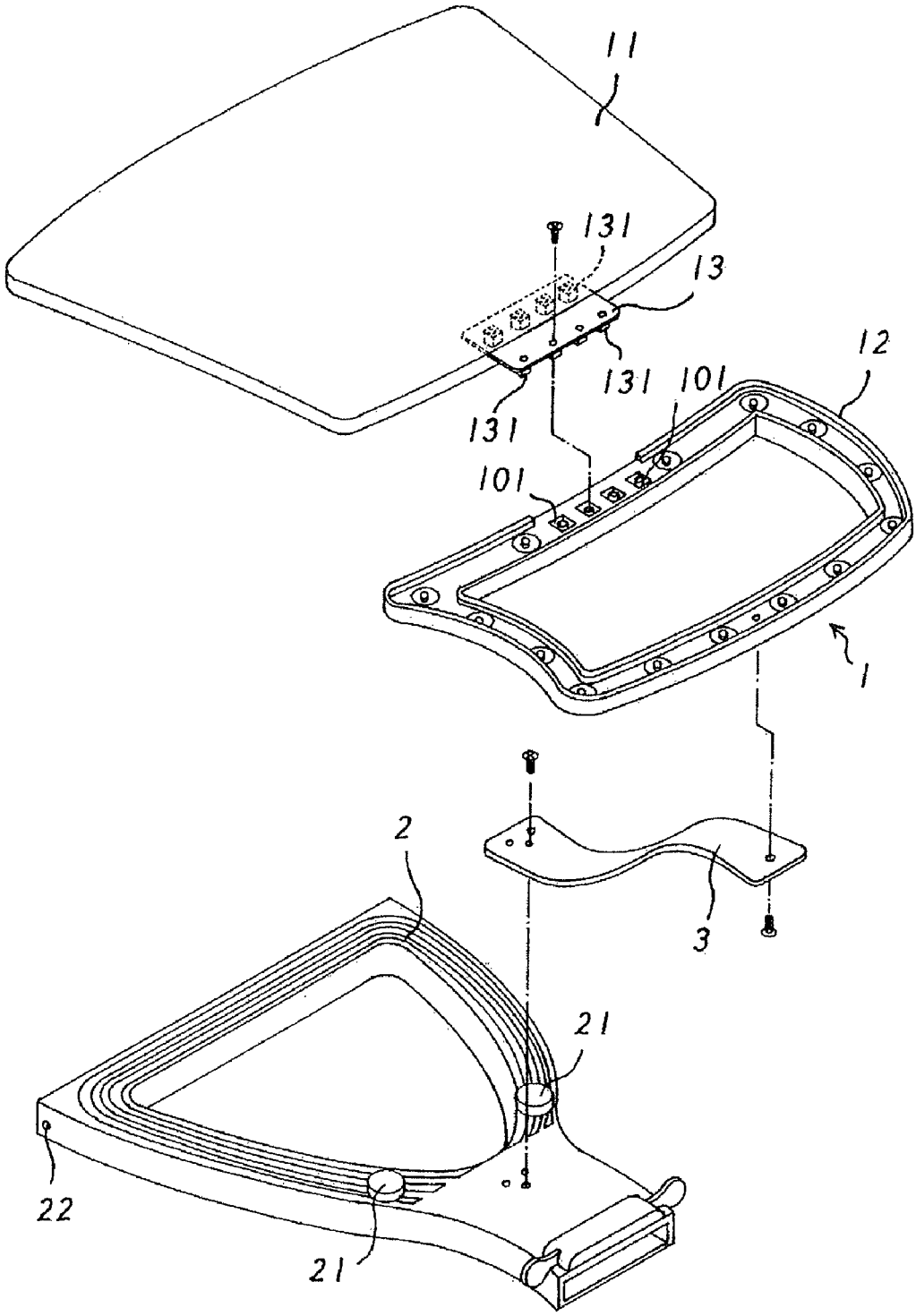
FIG. 1 is an exploded perspective view of a movable chair backrest in accordance with the present invention.
Figure 2:
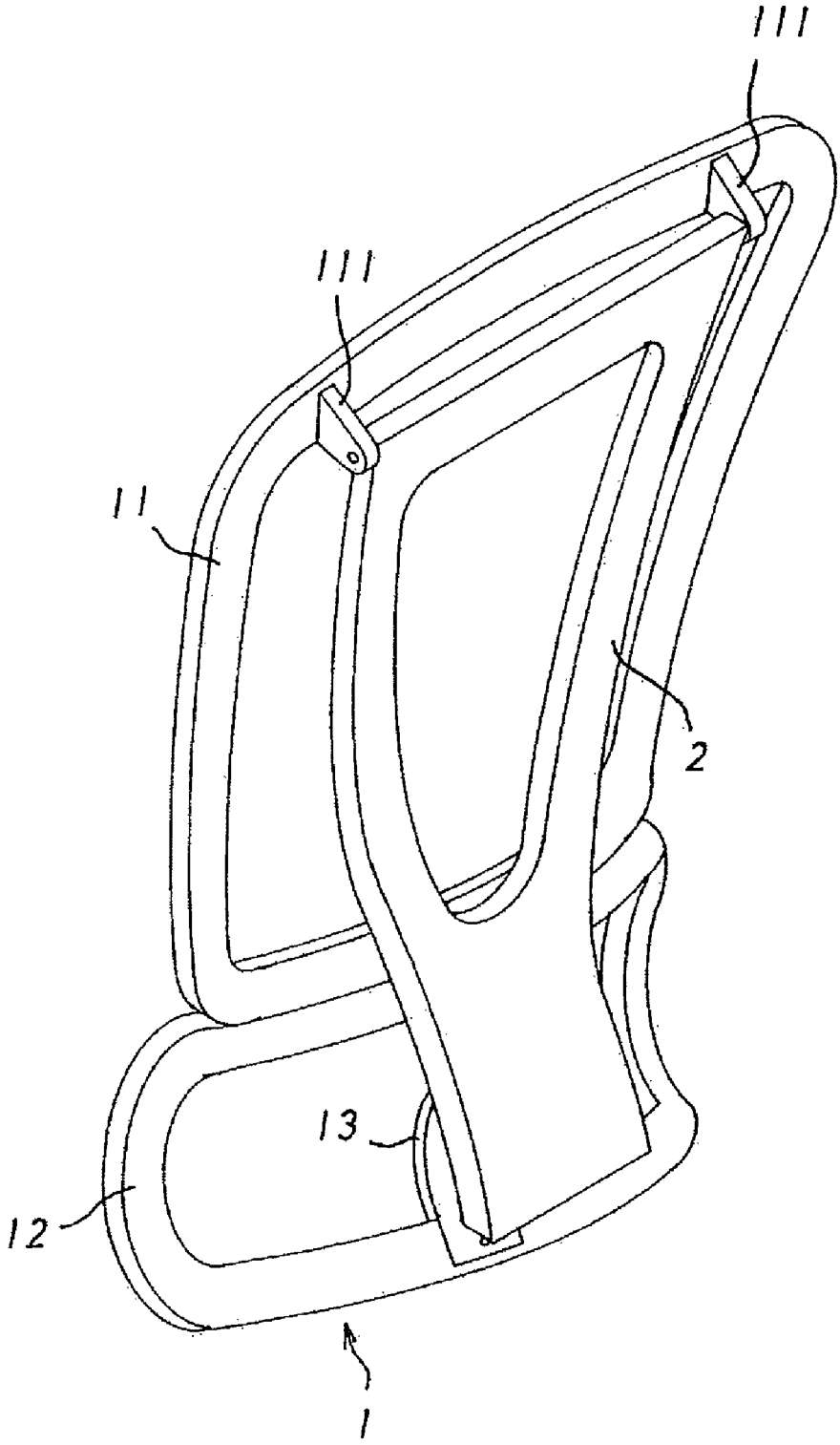
FIG. 2 is a perspective view of the movable chair backrest in accordance with the present invention.

A movable chair backrest in the present invention is illustrated in a first embodiment in which the backrest 1 is composed of an upper board 11 and a lower board 12 (as shown in FIG. 1). An upper end of the upper board 11 is pivotally attached to a backrest frame 2 in front thereof. Moreover, a bottom end of the lower board 12 is secured to the backrest frame 2 by a bouncing board 3 (as shown in FIG. 2).

The backrest 1 has an upper board 11 and a lower board 12. A bottom end of the upper board 11 is connected to a top end of the lower board 12 by a resilient sheet 13. The resilient sheet 13 is made of resilient, soft and endurable material, for example: rubber.

Figure 3:
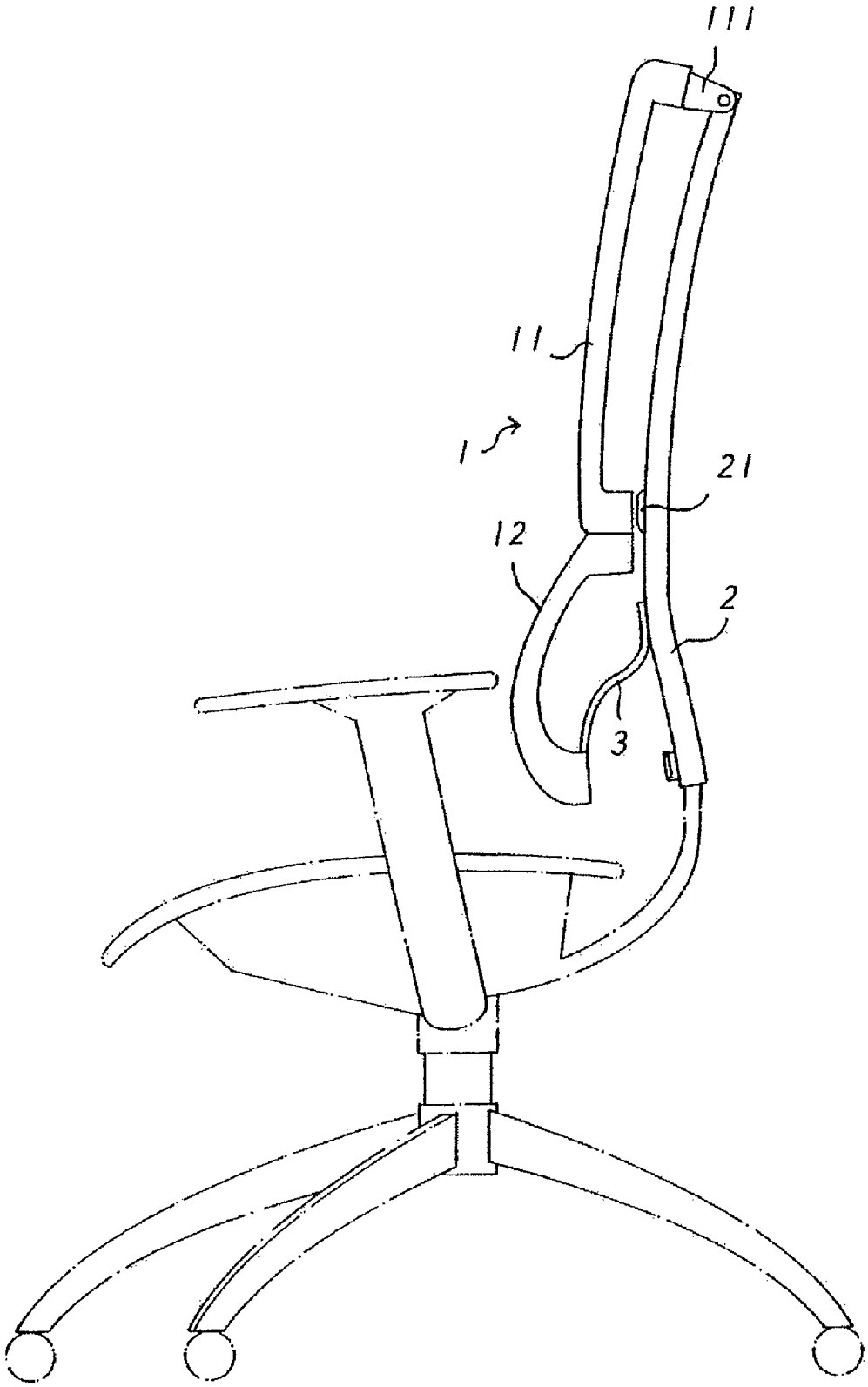
FIG. 3 is a cross-sectional side view of the movable chair backrest.

The backrest frame 2 is a Y-shaped frame, and its bottom end is combined to a seat to serve as a supporting frame (as shown in FIG. 3). Multiple buffering blocks 21 are mounted on the backrest frame 2 corresponding to an edge of the bottom end of the upper board 11.

By having the above construction, the upper end of the upper board 11 has two ears 111 extending backward to correspondingly align with the pivotal holes 22 on the backrest frame 2 for pivotal connection. Additionally, two ends of the bouncing board 3 are respectively secured to the bottom end of the lower board 12 and the backrest frame 2, so that the lower board 12 can be pushed forward by the supporting of the bouncing board 3 to make the whole backrest 1 raised from the backrest frame 2. The bottom end of the upper board 11 is also raised by the forward supporting of the lower board 12 to form a gap (a buffering distance) between the upper board 11 and the backrest frame 2. Thus, the movable chair backrest is completed.

Figure 4:
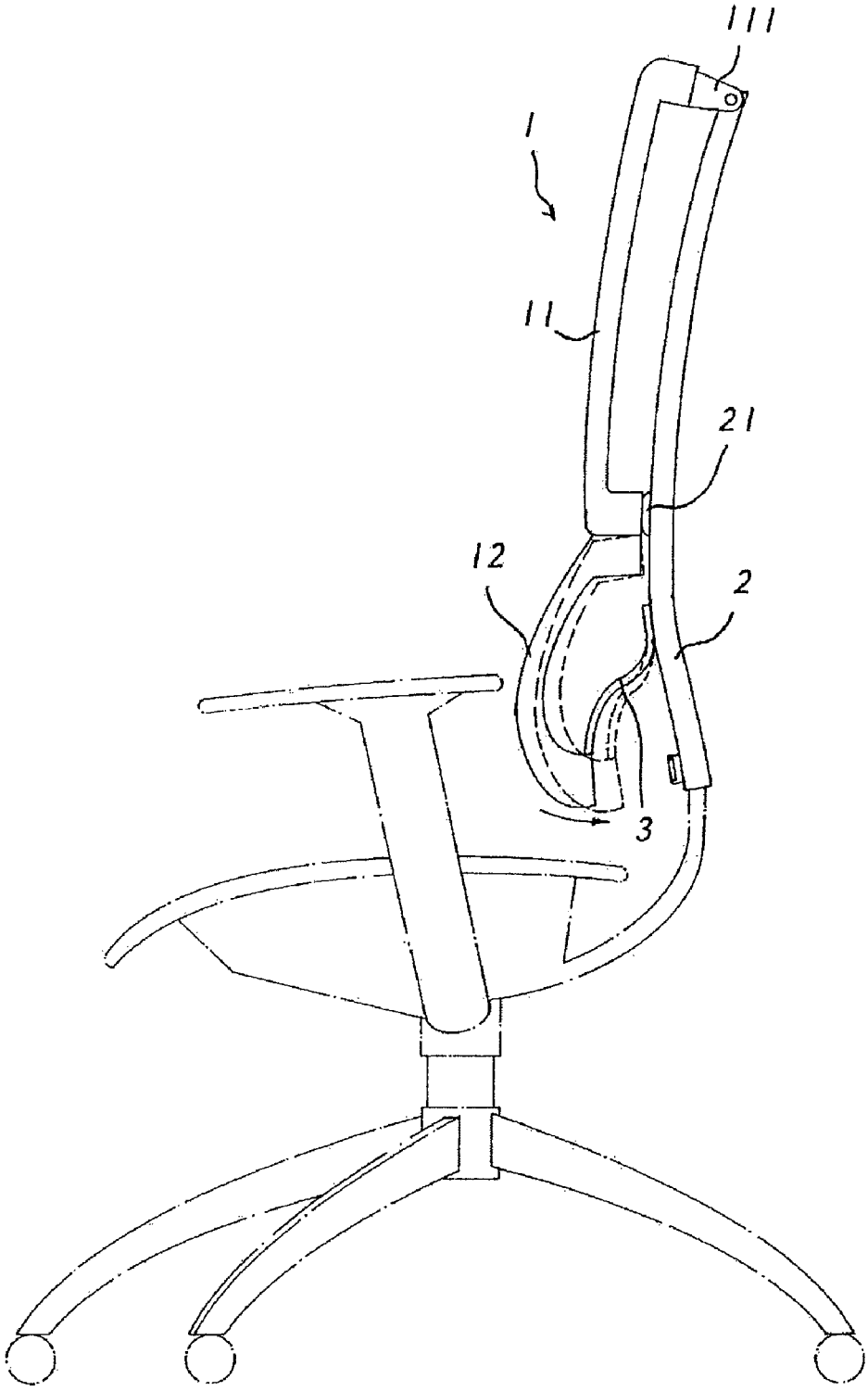
FIG. 4 is an operationally cross-sectional side view of the movable chair backrest.
Figure 5:
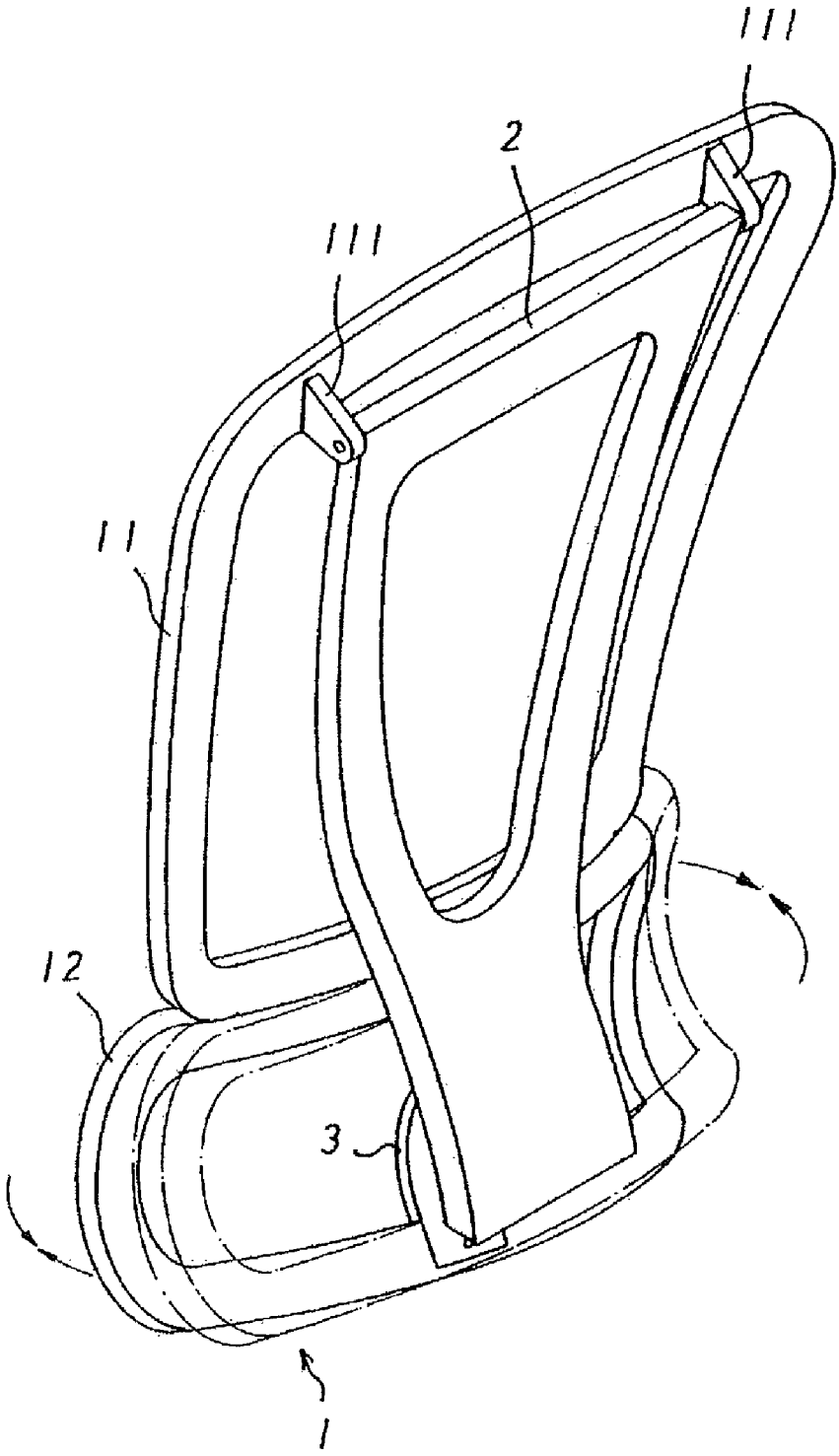
FIG. 5 is an operationally perspective view of movable chair backrest, with the lower board swinging.

When a user sits and leans on the backrest 1, the upper board 11 can correspondingly buffer and support the back of the user. The upper board 11 has a buffer efficiency by the forward or backward movement because of the connection to the bouncing board 3 mounted on the lower board 12. When the leaning force is strong, the multiple buffering blocks 21 on the backrest frame 2 are directly abutted by the upper board 11 and deform to provide a buffer efficiency to the pressure of the upper board 11. The user's waist leans on the lower board 12, so that the lower board 12 is directly influenced by the waist to move forward or backward by resilient deformation of the bouncing board 3 (as shown in FIG. 4). Therefore, the backrest 1 automatically responses to fit the user's back and, thus, has an adjustment efficiency to make users feel comfortable for compliance of body engineering. Moreover, when the user's sitting posture changes to slightly turn aside to lean on the backrest 1, the lower board 12 operationally rotates correspondingly to the twist of the waist as shown in FIG. 5, within a certain range. The lower board 12 rotates rightward or leftward relative to the upper board 11 by the resilient sheet 13. The bouncing board 3 is correspondingly twisted by the rotating force. Thus, the lower board 12 embraces the user's waist all the time and rotates correspondingly to provide support. Therefore, the user does not have a stiff or tired feeling even sitting on the chair for a long duration. Moreover, the backrest 1 sufficiently provides a buffering and supporting efficiency to keep the user's spine at a right position and comfortable.

To make the resilient sheet 13 have a better combination to the upper board 11 and the lower board 12, the resilient sheet 13 has multiple stubs 131 to wedge into multiple recesses 101 correspondingly defined on the upper board 11 and the lower board 12.

Figure 6:
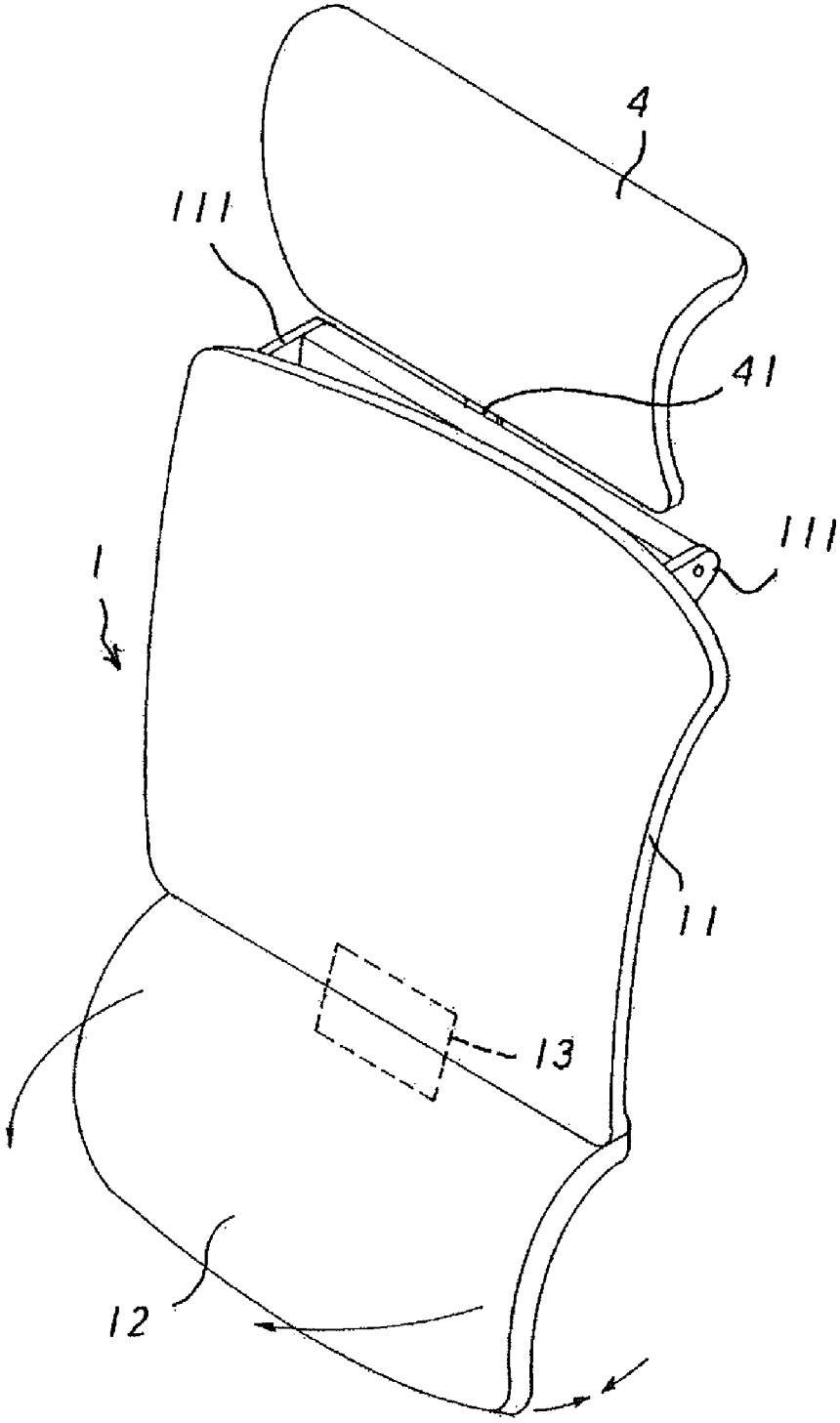
FIG. 6 is an operationally perspective view of an embodiment of the movable chair backrest in accordance with the present invention.

Another embodiment of the movable chair backrest in accordance with the present invention further has a headrest 4 with a supporting rod 41 to mount on the backrest frame 2 (as shown in FIG. 6). The headrest 4 cooperates with the backrest 1 to support the user's head and back.

Although this invention has been described in its preferred forms with a certain degree of particularity, it is understood that the present invention of the preferred forms has been made only by way of example and that numerous changes in the details of construction and the combination and arrangement of parts may be resorted to without departing from the spirit and scope of the invention.

What is claimed is:

1. A movable chair backrest comprising:

a backrest frame having a front face;

an upper board having an upper edge and a bottom edge;

a lower board having an upper edge and a bottom edge;

a resilient sheet connected to the bottom edge of the upper board and the upper edge of the lower board; wherein the upper edge of the upper board is pivotally attached to the backrest frame about a pivot axis parallel to the upper edge of the upper board; and a bouncing board, connected to the bottom edge of the lower board and connected to the front face of backrest frame at a connection, with the connection spaced from and intermediate the upper and bottom edges of the lower board, with the upper edge of the lower board and the bottom edge of the upper board being parallel to the upper edge of the upper board; wherein the bouncing board pushes the lower board apart from the backrest frame to make a buffering distance between the backrest frame and the backrest, with the bottom edge of the upper board abutable with the front face of the backrest frame intermediate the upper edge of the upper board and the bouncing board.

2. The movable chair backrest as claimed in claim 1, wherein:

the resilient sheet has multiple stubs; and the upper board and the lower board respectively have multiple recesses to correspondingly engage the multiple stubs on the resilient sheet.

3. The movable chair backrest as claimed in claim 1, wherein the backrest frame is a Y-shaped frame having a bottom end adapted to engage a seat to serve as a supporting frame and having at least one buffering block formed on the front face of the backrest frame to correspondingly align with the bottom edge of the upper board.

4. The movable chair backrest as claimed in claim 1, further comprising a headset with a supporting rod mounted on the backrest frame.

* * * * *